United States Patent [19]

Haury et al.

[11] Patent Number: 4,800,352

[45] Date of Patent: Jan. 24, 1989

[54] ELECTROMAGNETIC SWITCHING APPARATUS WITH INTERCHANGEABLE SWITCHES

[75] Inventors: André Haury, Le Raincy; Elie Bebel, Epinay sur Seine; Michel Lauraire, Courbevoie; André Vergez, Villennes sur Seine, all of France

[73] Assignee: La Telemecanique Electrique, France

[21] Appl. No.: 105,746

[22] Filed: Oct. 8, 1987

[30] Foreign Application Priority Data

Oct. 9, 1986 [FR] France ..... 86 14275

[51] Int. Cl.[4] ..... H01H 67/02

[52] U.S. Cl. ..... 335/132; 200/293

[58] Field of Search ..... 335/130–132, 335/129–129; 200/293, 303, 307, 309

[56] References Cited

U.S. PATENT DOCUMENTS 4,644,308 2/1987 Guery et al. ..... 335/132

4,713,498 12/1987 Ludwig et al. ..... 200/307

FOREIGN PATENT DOCUMENTS 50-30661 3/1975 Japan .

*Primary Examiner*—E. A. Goldberg
*Assistant Examiner*—Lincoln Donovan
*Attorney, Agent, or Firm*—William A. Drucker

[57] ABSTRACT

An electromagnetic switching apparatus with interchangeable switches is provided, including a base with a bottom and a cavity containing an electromagnet whose mobile armature, through a disconnectable transmission piece, actuates the mobile contact of a switch housed in an insulating case removably associated with a fixing face of the base opposite the bottom, said fixing surface including openings for the passage of said transmission piece, said base having connection terminals connected to contact pieces which cooperate with corresponding pieces connected to the switch.

6 Claims, 7 Drawing Sheets

ELECTROMAGNETIC SWITCHING APPARATUS WITH INTERCHANGEABLE SWITCHES

BACKGROUND OF THE INVENTION

1. Field of the Invention

The invention relates to an electromagnetic switching apparatus having a base whose bottom is fixed to a wall and in a cavity of which is disposed a control electromagnet with mobile armature adapted for actuating, through detachable coupling means, a transmission piece connected to a mobile contact of a single cut-out switch situated in an insulating case provided with opposite input and output terminals, this case being removably associated with a surface for fixing the base opposite the bottom.

Such an apparatus, which may be used in all power distribution systems may, depending on the embodiment of its controlled switch or switches, provide either repeated opening and closing of a circuit feeding a load, or else, and in association with devices sensitive to overloads or a current fault, provide automatic opening of the circuit for protecting the lines and/or the load.

2. Description of the Prior Art

A known apparatus, such as the one which is illustrated by the French Pat. No. 2 257 141 in the name of the applicant, and whose general construction recalls the one which is mentioned above, has solely the contactor function.

Within a general arrangement different from this latter, a circuit breaker apparatus is also known which is illustrated, for example, by the French Pat. No. 2 573 571 of the applicant, where a mobile piece of a single-cut out switch may be actuated either by a remote controlled electromagnet housed in a base, or else be opened by repulsion forces developed on the appearance of short circuit currents.

Finally, from the French Pat. No. 2 570 872 of the applicant and U.S. Pat. No. 4,644,308 of the assignor, a switch apparatus is known in which one or more control modules of different kinds may be associated with a base containing a controlled switch device, so as to confer on this switch one of the functions of supplying or protecting a load, which were mentioned above.

It is known that it is not easy to confer on the same switch a construction such that it is capable of responding with the same efficiency to operating conditions as different as those intended to provide either repeated opening and closing of the circuit and its load, or ensuring the protection thereof.

Under first working conditions of the contactor type, this switch must be able to maintain its mechanical and electric properties at a relatively high temperature which is developed by the frequent passage of currents going from the nominal current to 10 times this current Whereas, in working conditions of the circuit breaker type in which this switch will be rarely in action, the energy to be dissipated in the case during cut off of the very high currents will be much greater; in both cases, conditions of good residual insulation after numerous specific operations will have to be guaranteed in comparable ways.

Moreover, it is desirable to give the user the opportunity of rapidly changing a switch which has become defective without it being necessary to disconnect all the conductors which are connected thereto, an operation which is made difficult in an apparatus such as that defined in the French Pat. No. 2 257 141.

The present invention consequently provides an electric switching apparatus whose construction corresponds to that which is mentioned in the introduction and in which measures will be taken so that switch modules having different functions may be associated rapidly and without error with a standard base and separated therefrom without disconnection of the corresponding conductors, while providing each complete apparatus with an insulation of good quality.

SUMMARY OF THE INVENTION

This aim is reached in accordance with the invention because:

the fixing surface defines a closed cavity of the base, except for openings situated opposite a linkage piece connected to a mobile armature parallel to this face for the passage of ends of insulating transmission levers which are pivotally mounted in the removable contact case, and which cause mobile contact levers to rock which extend between connecting conductors placed in the vicinity of this fixing face end to which they are connected, whereas fixed contact supports are placed parallel in the vicinity of an external face of the case, the base further has connection terminals which permanently receive external conductors of the circuit, and which are connected to contact pieces cooperating resiliently with corresponding pieces secured to the removable case and connected to the switches.

BRIEF DESCRIPTION OF THE DRAWINGS

The invention, as well as other features thereof, will be better understood from reading the following description with reference to the accompanying FIGS. which show.

DESCRIPTION OF THE PREFERRED EMBODIMENTS

Figure 1:
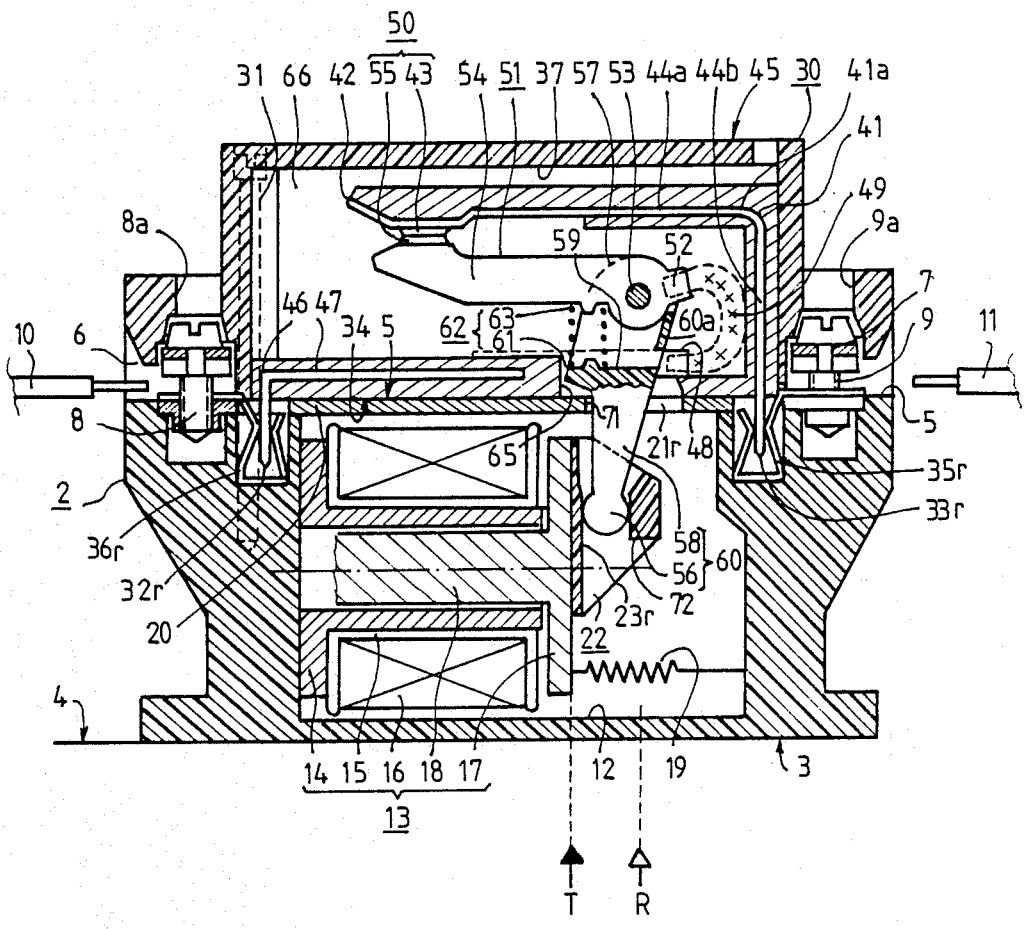
FIG. 1, an elevational view of a first apparatus according to the invention, which includes a switch case having a first function and is cut through a longitudinal plane passing through the axis of movement of a mobile electromagnet piece of a first type which is substantially parallel to a straight line passing through the connection terminals.

An electric switching apparatus 1, shown in FIG. 1, includes a base 2 having: a bottom 3 for fixing it to a wall 4, an opposite fixing or reception face 5, two sets of opposite terminals 6, 7 which are intended to be connected, e.g. by means of screws 8, respectively 9, to a supply line 10 and to a load line 11, and which are disposed substantially at the level of the fixing face, and a closed cavity 12 opening towards this face in the embodiment shown.

An electromagnet 13, which is disposed in this cavity, includes, in a way known per se, a fixed yoke 14, a coil carcase 15 and energization coil 16 for attracting a mobile armature 17 and/or a plunger core 18, which are urged by a return spring 19 to a rest position -R-; this armature moves along a translational axis XX' substantially parallel to the fixing face depending on whether the coil is or is not energized through control terminals which are connected thereto, but which are not shown in this FIG. This electromagnet may be of the monostable or bistable type and may include one or more permanent magnets if its changes of state are to be caused by current pulses; in this latter case, the return spring may be omitted.

Cavity 12 is mainly closed by a cover 20 which is placed in the plane of face 5 which is fixed to base 2, and which has a set of openings 21 only one of which $21_r$ is visible. These openings are placed opposite a separable coupling piece 22 which is itself fixed to the armature and which has, for example, a set of housings 23 only one of which $23_r$ is visible; these housings are placed opposite the corresponding openings 23.

An insulating switch case 30 is removably associated with this base, on the one hand, through mechanical fixing means, such for example as screws 31 extending as far as a tapped hole in this base, and on the other hand, through removable electric connection means such as two sets of conductor knives 32, 33, two of which $32_r$, $33_r$, are visible in this FIG.

In the embodiment illustrated by way of example, these knives project with respect to a support face 34 of the case 30 and are plugged into sets of resilient current sockets 35, 36 only two of which $35_r$ and $36_r$ are visible; these current sockets, which are electrically connected to the adjacent connection terminals, are preferably fixed mechanically by these latter.

The engagement of the knives in the corresponding sockets is obtained entirely when the fixing 5 and support 34 faces are against each other.

In an inner volume 37 of the case is disposed a set 40 of electric switches whose number is equal to that of the set of terminals.

A particular switch, such as 50 which is the only one visible in this FIG., includes a fixed conducting support piece 41 on an internal end 42 of which is disposed a fixed contact 43, whereas the other opposite external end represents knife $33_r$: this piece includes an appreciable portion $44_a$ which moves parallel to an external face 45 of the case in an insulated groove $41_a$, and a bent portion $44_b$ passing close to a terminal 9. A second conducting piece 46, an external end of which represents the knife $32_r$, has an appreciable portion 47 which moves parallel to the support face 34 and in the vicinity thereof as well as an opposite internal end 48 which is connected by a flexible conductor or braid 49 to a mobile contact lever 51.

A central region 52 of this latter, receiving the braid, rocks about a pivot 53, whose axis is parallel to the support face, which is fixed with respect to the case, and has an arm 54 which extends substantially parallel between portions 47 and $44_a$ of conductors 46, respectively 41; the free end of this arm carries the mobile contact 55 which forms, with the fixed contact 43, a particular switch 50 of the set of switches 40.

With the mobile contact 51 is associated an insulating transmission lever 60, having, for example, a hub in the form of a fork 57, in its turn rocking about pivot 53 and an arm 58 which passes through an opening 65 in face 34 so that its end 56 is engaged in housing 23; this arm, which extends in a direction substantially perpendicular to that of the arm of lever 51, passes close to an offset portion 48 of conductor 46 and has, at this level, a fork bottom 59 intended to receive a first end 61 of a compression spring 62 providing the contact pressure, whereas the other end 63 bears on lever 51 so as to communicate thereto a torque of appropriate direction for the pressure of the mobile contact 55 to be exerted against the fixed contact 43.

It can be seen that the present arrangement is advantageous to the extent that conductor 46 and the contact lever 51 are at the same potential and to the extent that the path of this conductor frees a space 66 adapted for receiving fractionating fins of an arc chamber for the electric arcs, whereas the ends of the portions of conductor $44_a$, $44_b$ which are bent form with the braid 49 and lever 51 a current loop promoting the movement of these arcs towards this chamber; these advantages are here obtained in an overall reduced switch volume.

Taking into account the fact that the measures which have just been described make it easy to remove a switch case from its base or put it back in position thereon, it is necessary to make arrangements so that such operations cannot be carried out when the switch is closed or when the electromagnet is supplied with power. In fact, if such manoevers were possible, the separation of the knives from the current sockets or plugging thereof therein, could cause damage at the time the current is established.

Figure 2:
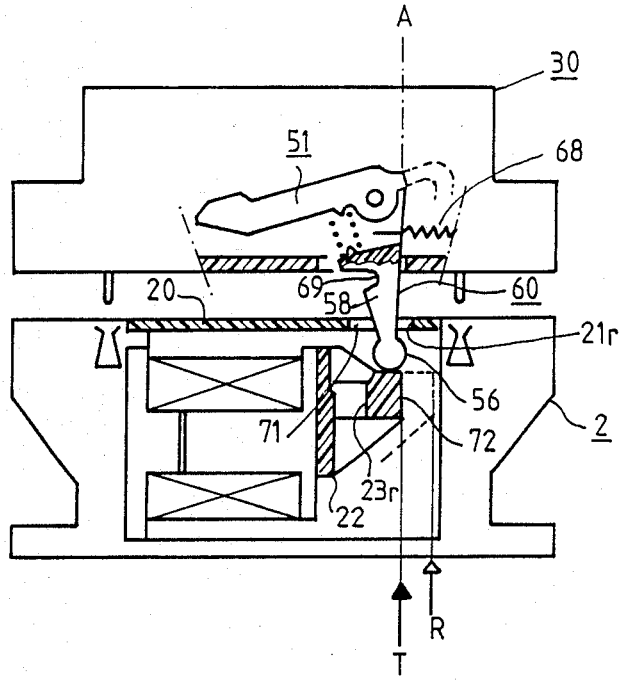
FIG. 2, a simplified elevational view of the apparatus of FIG. 1, in which a base and a switch case having preventing means have been separated.

Among the measures capable of making plugging in impossible, we may mention the one which uses the arrangements shown in FIG. 2, where it can be see that (with or without the use of an auxiliary return spring 68 giving the transmission lever 60 a stand-by position A when the switch case is not yet associated), the end 56 cannot be engaged in housing $23_r$ after passing through opening $21_r$ when the armature and the coupling piece 22 which it carries are in the working position -T-.

This impossibility is hereagain guaranteed by the fact that a tangential recess 69 in arm 58 of the transmission lever cannot come opposite the edge 71 of opening $21_r$ when end 56 abuts against the portion 72 of the coupling piece extending this housing $23_r$.

Figure 3:
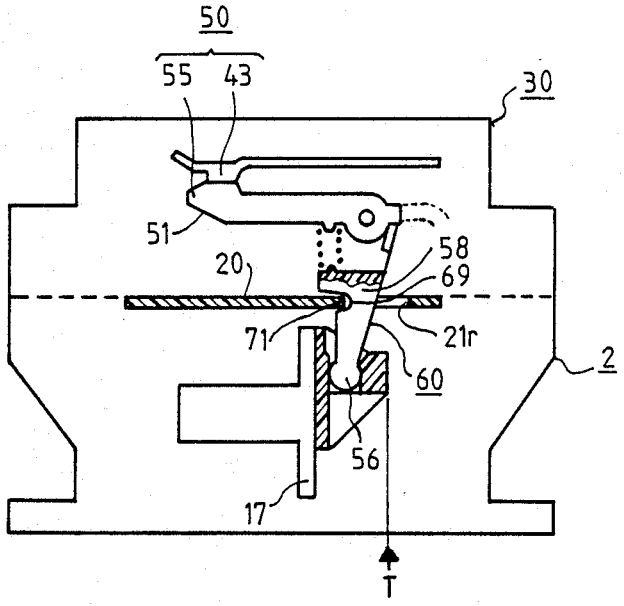
FIG. 3, a simplified elevational view of the apparatus of FIG. 2, in which the the base and the switch case are assembled together inseparably through the prevention means and for a particular state of the electromagnet.

The cooperation of recess 69 with the wall of cover 20 which is contiguous with the edge 71 of opening 21, makes it further impossible to remove the contact case 30, if the electromagnet is in its working condition -T-, see FIG. 3.

Figure 4:
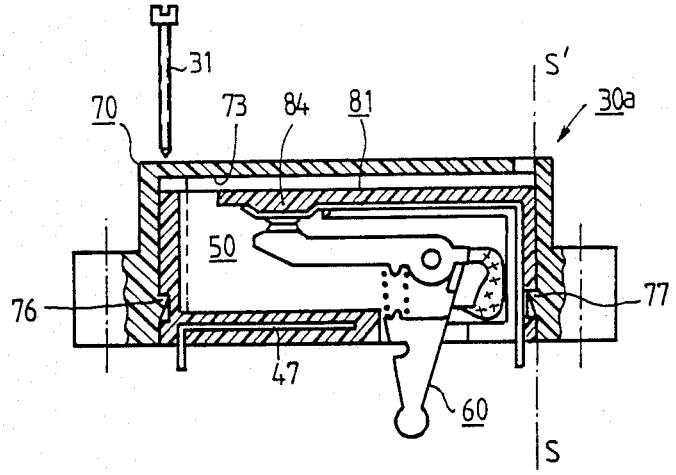
FIG. 4, a simplified elevational and sectional view of a switch case obtained by the association of several modules.
Figure 5:
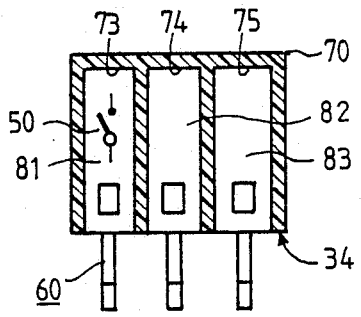
FIG. 5, a side view of the case shown in FIG. 4 cut through a transverse plane SS' thereof.

In a particular embodiment of the switch case $30_a$, see FIGS. 4 and 5, it is formed by an insulating case 70 in which three isolated compartments 73, 74, 75 are for example formed which open towards the support face 34 and which each receive an insulated switch cartridge such as 81, 82, 83, see FIG. 5. Each of these cartridges contains the elements of a switch such as 50 described above, but it is then incorporated in a particular closed case 84 which is adapted to cooperate with snap fit retention means such as 76, 77 carried by case 70, see FIG. 5.

Figure 6:
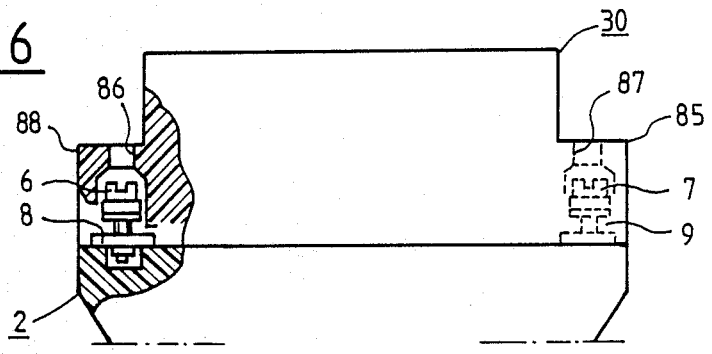
FIG. 6, a general view of a switch case in elevation where a region receiving terminals and cooperating with the base is shown in detail.

As can be seen in FIG. 6, screws 7 adn 6 of the supply terminals 9 and 8 are disposed between base 2 and the external flanges 88; 85 of case 30, which are formed with holes such as 86, 87 for passing a screw driver therethrough; these flanges may limit the movement of the screw heads by covering them so that they cannot be lost and so as to isolate them from the outside.

Figure 7:
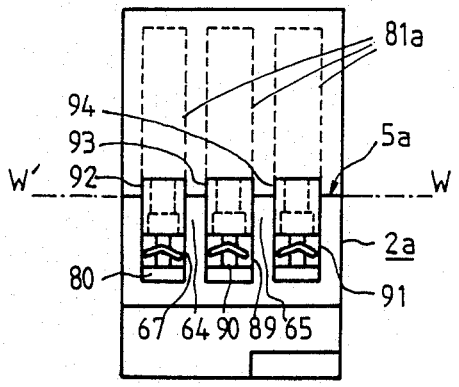
In FIG. 7, an external side view of an apparatus of the invention, but showing a variant of the arrangement of the connection terminals.
Figure 8:
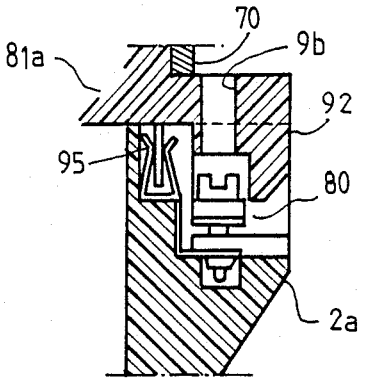
FIG. 8, an elevational and sectional view of detail of the terminals shown in FIG. 7.

In order to improve the insulation between two adjacent connection terminals 80, 90 or connection socket 95 during service, see FIGS. 7 and 8, and to protect them as a whole against any outside contact, when the switch case is removed, these terminals, isolated by dividing walls 64, 65, may be disposed in housings in a base $2_a$ such as 67, 89, 91 which are situated below plane WW' of the fixing face $5_a$, see FIG. 7; flanges 92, 93, 94 which protect the screws of these terminals may, if required, be disposed on the opposite ends of a particular contact cartridge $81_a$, see FIG. 8.

The operation of the contactor apparatus which has just been described is solely dependent on the operation of the electromagnet; when this latter is energized and when the armature is in the work position -T-, the bottom 59 of the fork communicates a resilient clockwise torque to lever 51 because of the intermediate presence of the contact pressure spring 62, and the lever causes the two contacts 55, 43 to meet; when the electromagnet is de-energized and when the armature moves towards its rest position -R- under the effect of spring 19, the transmission lever 60 pivots in an anticlockwise direction and a stop $60_a$, placed between the arms of the fork 57, comes to bear on the central region 52 so as to drive lever 51 in the same direction, which causes separation of the contacts 55, 43.

The arrangements which have just been described allow limited production means to be used to the extent that the same base may receive switch cases having different functions or, as the case may be, different nominal ratings.

Figure 9:
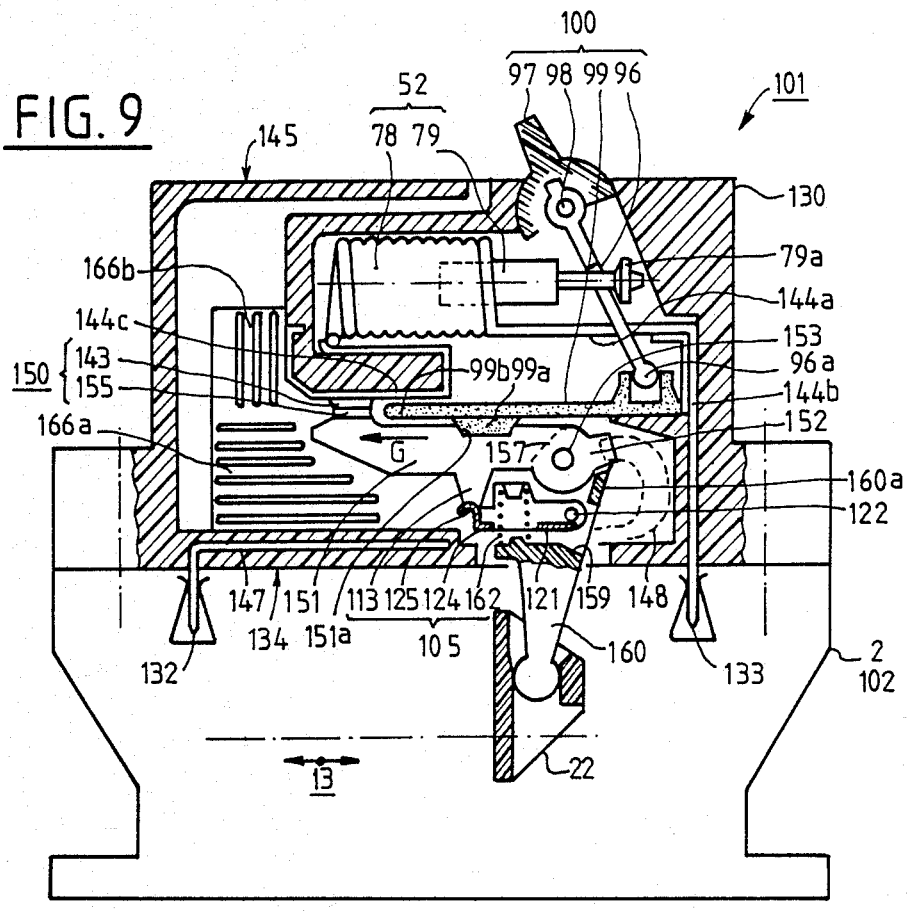
FIG. 9, an elevational view of a second apparatus in accordance with the invention which includes a switch case having a second function and is cut through a longitudinal plane.

Thus, with one of the bases 2, respectively $2_a$ which have just been described, may be associated a protection switch case 130 with automatic opening 150 so as to obtain an apparatus 101 of the automatic opening and remote control circuit breaker or limiter type, shown in FIG. 9.

The case 130 here contains a mobile contact lever 151 which is associated with an insulating transmission lever 160 by means of an escape device 110 using the contact pressure spring 162.

Figure 10:
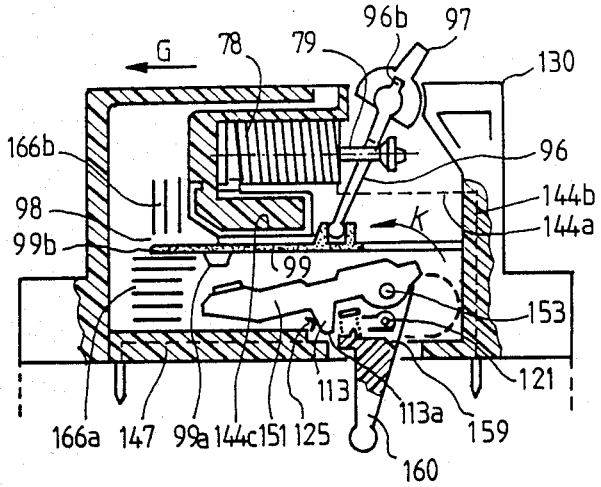
FIG. 10, a simplified longitudinal sectional view of a switch case, such as shown in FIG. 9, where the switch is in the open state immediately after the appearance of a current fault.
Figure 11:
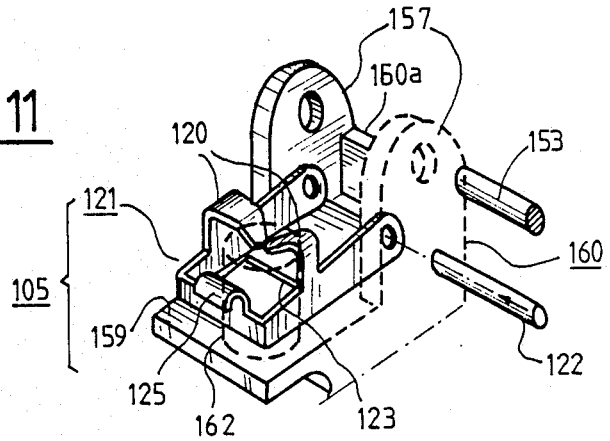
FIG. 11, a perspective view of a detail of the escape mechanism which allows the rapid movement of the contact lever of the switch shown in FIG. 10.

This latter bears, on the one hand, against a bottom 159 of the fork 157 of the transmission lever 160, and, on the other, against a cross piece 120 of a swinging threshold bolt 121 which is pivotally mounted in the fork by means of a parallel pivot 122 disposed between the bottom 159 and the pivot 153 of lever 151, see FIGS. 9 and 10; an opening 123 in this bolt allows spring 162 to pass therethrough, see FIG. 11.

A free end 124 of the bolt has an excentric boss 125 which meets a tangential extension 113 of lever 151 placed between its ends, and which communicates thereto a clockwise torque for communicating a contact prsesure to the mobile contact 155; switch 150 having the two contacts 143, 155 is placed in the vicinity of a first arc chamber $66_a$ which will be swept by the mobile contact moving in an anticlockwise direction.

As in the connection mode in the preceding example, a conducting braid 148 connects a conducting piece 147 to a central region 152 of lever 151 able to cooperate with a stop $160_a$ of the fork 157.

This fixed contact 143 is here carried by a fixed conducting piece $144_c$ a first end 142 of which links up with a second arc chamber $166_b$, whereas a second bent end of this piece links up with a coil 78, having its axis substantially parallel to the support surface 134, whose center is occupied by a magnetizable core or striker 79, the coil and the striker core form one of the fault current detectors 52 which may be incorporated in the case and associated with the internal circuit of the apparatus. A second conductor $144_a$, parallel to lever 151 and connected to the coil is extended by a portion $144_b$, bent at 90°, which joins up with a connection end or plug or knife 133.

Generally, the conducting pieces $144_c$, 78 and $144_a$ extend in the vicinity of a front face 145 of case 130.

The energy developed by the magnetic overcurrent detecting device 52 including coil 78 and striker 79 is here used for causing directly forced opening of the mobile contact 155. Such opening, which must occur when the striker is attracted very rapidly, uses a percussion lever 96 which swings about the case pivot 98 common to a manual operating member 97, and which is coupled to the end $79_a$ of the striker. The free mobile end $96_a$ of the percussion lever, in its movements in direction G, drives an isolating screen 99 one end $99_b$ of which may move parallel to lever 151 while inserting itself between the two contacts 143, 155 as soon as they are separated.

When opening of the circuit of the apparatus is caused by the remote control electromagnet, the isolating screen remains motionless and the operation is at all points comparable to taht of the preceding apparatus.

When intense and instantaneous currents flow through the circuit, the striker is suddenly attracted, and the screen moves in direction G, see FIG. 10; a boss $99_a$, placed on the screen and housed at rest in a recess $151_a$ of lever 151, then communicates to this lever an anti-clockwise movement which causes a prior separation of contacts 143, 155 sufficient for the screen to be able to pass therebetween and to draw out the arc as far as a region 98 common to both the chambers $166_a$, $166_b$. In a final position of the screen, shown in this FIG., this latter causes not only material galvanic isolation between the two contacts, but also an isolated separation between the two chambers $66_a$ and $66_b$.

A similar although slower operation is provided when the manual member 97 is pivoted in a clockwise direction through the unilateral drive which connects it to the end $96_b$ of the percussion lever 96.

When very intense currents, reaching the level of those of short circuits, flow through the circuit of the switch, the response time of the coil, of the striker and of the screen is not sufficiently short to provide an efficient limitation of these currents.

The automatic opening of switch 150, in this case, uses essentially the repulsion forces which are developed between the conductor represented by lever 151 and the conducting pieces $144_c$, $144_a$ which are parallel thereto, and which are used in a mechanical device with tripping threshold 105.

Figure 12:
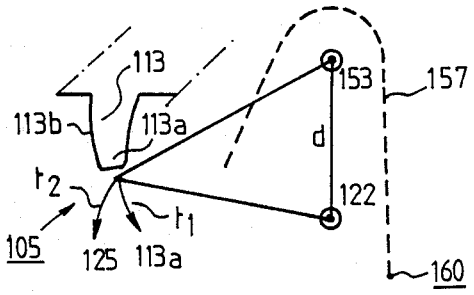
FIG. 12, a schematical view of the geometric interactions of two pieces of the escape mechanism.

An appreciable anti-clockwise torque K, which is applied to lever 151, communicates thereto a rotation in the same direction about its pivot 153, see FIGS. 10 and 12.

In a first fraction of this pivoting movement, spring 162 is compressed by the cross piece 120 because of the force applied by the extension 133 to the boss 125 of bolt 121.

Considering the distance -d- which separates pivots 153 and 122, end $113_a$ and boss 125 will move in a second fraction over divergent paths $t_1$, $t_2$, which results in separating these ends, see FIG. 12; a ramp $113_b$ of extension 113 which is substantially concentric to pivot 153 will then rub against a rounded surface of boss 125 without receiving therefrom any appreciable friction torque. Lever 151 may then move suddenly away from its closed position so as to take up a position illustrated in FIG. 10, where end $113_a$ is passed through opening 123, see also FIG. 12.

Since coil 78 attracts core 79 with a slight delay with respect to the movement of lever 151, screen 99 comes between the contacts 155, 143 before the lever has again moved towards its closed position under the effect of spring 162 or possible bouncing, which establishes total isolation of the circuit.

Figure 13:
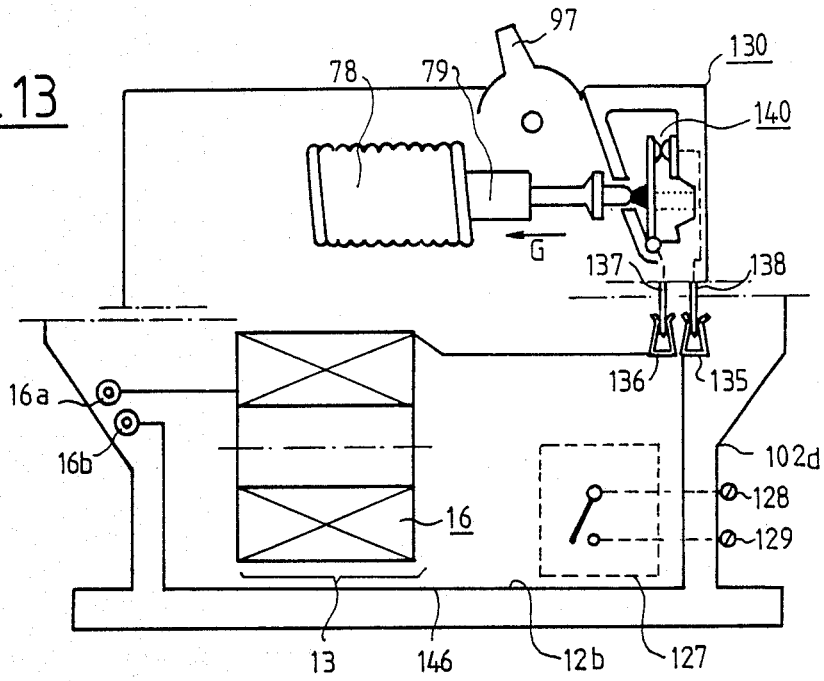
FIG. 13, a simplified elevational view of an apparatus such as shown in FIG. 9, in which additional means are shown for forming an opening occurring on the appearance of a current fault.

Confirmation of the open position of lever 151 may nevertheless be obtained by immediate de-energization of the remote controlled electromagnet 13; for this, the supply circuit 146 for coil 16 may include a safety switch 140 which is placed in series therewith and which is opened when the striker 79 is attracted in direction G by coil 78, see FIG. 13. Such an arrangement of course involves the presence of interconnection plugs or knives 137, 138 on case $130_a$ and additional sockets 135, 136 on base $102_d$ when the safety switch is disposed in case $130_a$; this base here further carries control terminals $16_a$, $16_b$ to provide the external supply of the circuit of coil 16.

Resetting of the apparatus requires the screen to be again in its original position, which operation is performed through manual action on member 97 and in an anticlockwise direction.

To prevent errors in the choice of functional switch apparatus occurring at the time of mounting or replacement, to prevent for example a contactor switch case from being mistakenly substituted for a protection switch case on a base already installed, cooperating indexing means are disposed on the fixing surface of the base and on the support surface of the case, which makes such substitutions impossible; associations of colors may also be used.

Figure 14:
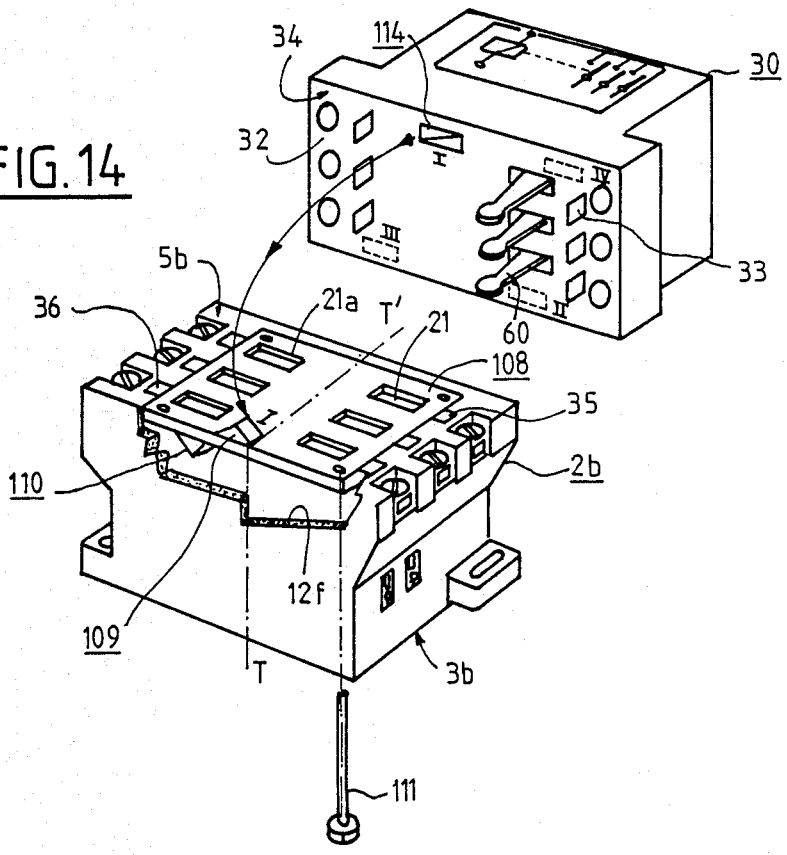
FIG. 14, a perspective view of a base and a switch case separated from each other to show the presence of indexing means provided for preventing the assembly of two non compatible elements.

In an advantageous embodiment, programmable mechanical indexing means are disposed on the fixing face of the base, for example on a reversible cover 108 closing the cavity $12_f$, see FIG. 14.

This cover may for example have on each opposite face $108_a$, $108_b$ one or more fingers or projections, such as 109, respectively 110, whose arrangement on the fixing face $5_b$ may be modified, on the one hand, through a 180° pivoting movement in its plane and, on the other hand, through turning over; thus four switch case functions I, II, III, IV may be specified, each one havig specific indentations such as 114.

Figure 15:
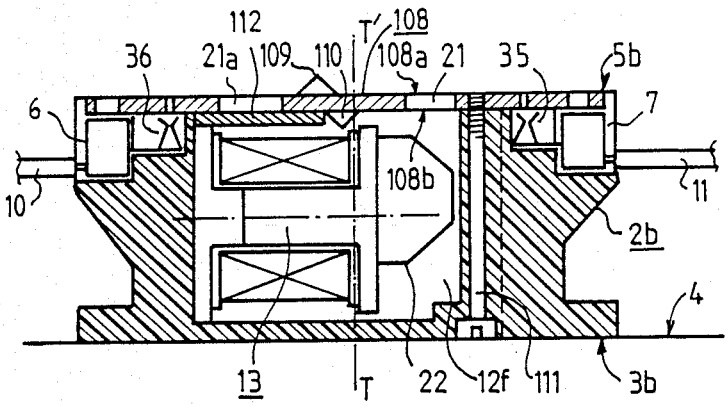
FIG. 15, a simplified elevational and longitudinal sectional view of a base such as that shown in FIG. 14.

Reorientation of this cover 108, which must be made impossible or very difficult when the apparatus has already been wired so as to prevent frauds, may for example be obtained by fixing it by means of screws 111 passing through base $2_b$ from the coupling face $3_b$ applied to plate 4; when the base is mounted and the conductors 10, 11 are installed, the heads of these screws are invisible and inaccessible, see FIG. 15.

Wrong orientation of the switch case with respect to the base is made impossible because the coupling means 22, 23 as well as the openings 21 giving access thereto are offset with respect to a median transverse plane TT' of the base; openings $21_a$, which are themselves disposed symmetrically with respect to this plane so as to allow the transmission levers 60 to pass therethrough in certain configurations, come opposite a protection mask 112 which covers the electromagnet 13, see FIGS. 14 and 15.

In a particular embodiment, the cover may also cover the connection sockets 35, 36 and/or the connection terminals 6, 7, for protecting same, when the switch case is separated from the base, see FIG. 15.

As can be seen in FIG. 13, in each of the cavities such as 12, $12_b$, $12_f$ there may also be disposed one or more auxiliary switches, such as the one shown with broken lines 127, whose signal terminals 128, 129 are accessible on the case $102_d$.

In the cavity a remote controlled opening electromagnet 170 may be disposed which is of the monostable or bistable type, having one or more permanent magnets.

Figure 16:
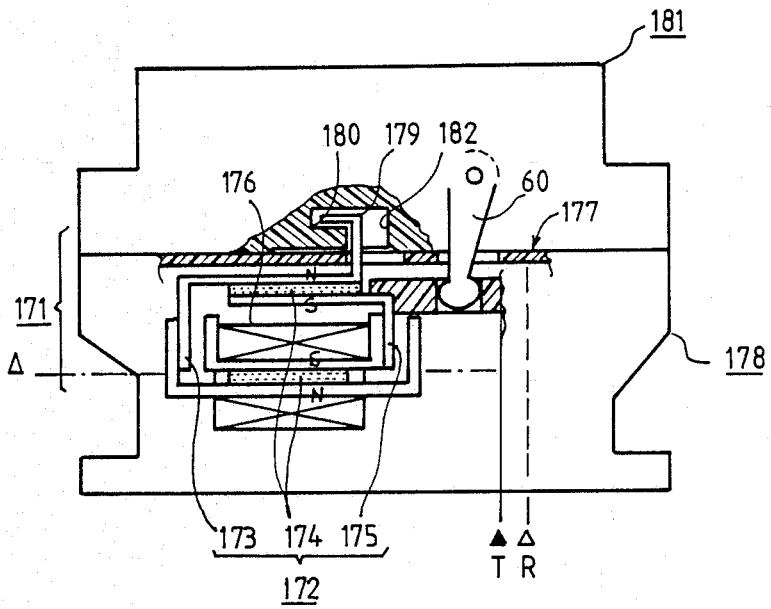
FIG. 16, a partial elevational and sectional view of an apparatus having a second type of electromagnet and a second type of prevention means.

If an electromagnet 171 is used in which the mobile armature 172 is formed by a system of magnetizable pieces and magnets 173, 174, 175 substantially parallel to the axis -Δ- of the coil 176 and moving outwardly thereof in this direction, see FIG. 16, it may be advantageous to plce this mobile system on the same side as the fixing face 177 of base 178, and to provide it with a hook 179, for example projecting, for preventing dangerous separation and engagement of the case, for which means have already been proposed in FIGS. 2 and 3; this hook here cooperates in the work position -T- with an elbow recess 180 of the removable case 181 whose profile prevents the separation, while the dimensions of the recess prevent engagement.

What is claimed is:

1. An electromagnetic switching apparatus comprising:

i. an insulating base having a coupling wall provided with at least one opening and input and output socket contacts mounted in said coupling wall;

ii. actuating electromagnet means housed in said base and having an armature movable along a first direction parallel to said wall from a rest to an actuated positions and at least one coupling member attached to said armature and having an elongate receptacle substantially extending at right angles to said coupling wall;

iii. at least one insulating case having a fixation wall adapted for removably mating with said coupling wall; at least one aperture being provided in said fixation wall and registering at least partially with said opening and input and output conductor portions outwardly protruding from said fixation wall to plug-in into the respective socket contacts;

iv. switch means connected to said conductor portions and housed in said case, said switch means comprising at least one fixed contact, at least one movable contact and at least one pivotable lever holding the movable contact for effecting a displacement of the movable contact from a closed to an open condition of the switch means when the armature is in the actuated position, said displacement being effected in a second direction substantially perpendicular to said coupling wall, said holding lever pivoting about an axis substantially perpendicular to said first and second directions;

v. at least one insulating layer pivotally mounted about the axis of the holding lever and driving the latter for displacing the movable contact, said insulating lever passing through said opening and said aperture and having a coupling head which is removably engaged into said receptacle and vi. locking means for preventing engagement in said head into said receptacle and disengagement of said head from said receptacle both in the closed condition of the movable contact and when the armature is in its actuated position.

2. The electromagnetic switching apparatus of claim 1, wherein said locking means include a recess formed in the insulating layer, said recess being engaged with the coupling wall when the armature is in its actuated position.

3. The electromagnetic switching apparatus of claim 1, wherein said locking means include a stop surface portion of the coupling member against which said head will abut for preventing it to engage the receptacle when the armature is in its actuating position and the movable contact is open.

4. The electromagnet switching apparatus of claim 3, wherein said locking means include a return spring connected to the insulating lever and which puts the insulating lever in a position where said head abuts against said stop surface portion when the armature is in its actuated position.

5. The electromagnetic switching apparatus of claim 1, wherein said apparatus comprises a plurality of interchangeable insulating cases, a plurality of switch means housed in the respective cases and permanent indexing means to identify the respective switches, while the insulating base includes programmable indexing means for preventing coupling to the base of a case different from that which was originally chosen.

6. The electromagnet switching apparatus of claim 5, wherein the coupling wall of said base receives a reversible and orientable cover which is mounted for taking anyone of four positions with respect to the base, said cover carrying an outer and an inner studs which form the indexing means and said studs take up a different position on the coupling wall.

* * * * *